US009250582B2

(12) United States Patent
Suzumi et al.

(10) Patent No.: US 9,250,582 B2
(45) Date of Patent: Feb. 2, 2016

(54) FIXING APPARATUS

(71) Applicant: CANON KABUSHIKI KAISHA, Tokyo (JP)

(72) Inventors: Masahiko Suzumi, Yokohama (JP); Masahito Omata, Yokohama (JP); Shoichiro Ikegami, Yokohama (JP); Sho Taguchi, Yokohama (JP); Takeharu Nakada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/539,851

(22) Filed: Nov. 12, 2014

(65) Prior Publication Data

US 2015/0139707 A1 May 21, 2015

(30) Foreign Application Priority Data

Nov. 20, 2013 (JP) ..... 2013-240148

(51) Int. Cl.
*G03G 15/20* (2006.01)
*G03G 15/00* (2006.01)

(52) U.S. Cl.
CPC ..... *G03G 15/2053* (2013.01); *G03G 15/2042* (2013.01); *G03G 15/65* (2013.01)

(58) Field of Classification Search
CPC G03G 15/2053; G03G 15/2042; G03G 15/65
USPC ..... 399/329
See application file for complete search history.

(56) References Cited

U.S. PATENT DOCUMENTS

2005/0163523 A1* 7/2005 Omata et al. ..... 399/69
2006/0157464 A1* 7/2006 Omata et al. ..... 219/216
2009/0220288 A1* 9/2009 Omata ..... G03G 15/2042 399/333
2011/0286775 A1 11/2011 Ishihara
2012/0308253 A1* 12/2012 Kurata ..... G03G 15/2042 399/69
2014/0169845 A1* 6/2014 Nakahara ..... G03G 15/2053 399/328
2014/0186078 A1* 7/2014 Imaizumi et al. ..... 399/329

FOREIGN PATENT DOCUMENTS

EP 1879080 A1 1/2008
JP 05-265350 A 10/1993
JP 10-031379 A 2/1998
JP H10-232576 A 9/1998
JP 2004-252301 A 9/2004
JP 2005-173446 A 6/2005
JP 2006-084647 A 3/2006

* cited by examiner

*Primary Examiner* — Francis Gray

(74) *Attorney, Agent, or Firm* — Canon U.S.A., Inc. IP Division

(57) ABSTRACT

A fixing apparatus configured to heat a recording material having a toner image formed thereon and fix the toner image fixing on the recording material comprising: a film; a heater configured to contact the film, the heater including a substrate and a heat generation resistor formed on the substrate; a thermal conduction member configured to contact a surface of the heater opposite to a surface of the heater that contacts the film, the thermal conduction member having a thermal conductivity higher than that of the substrate; and a pressurizing roller configured to form a pressing portion with the heater via the film, wherein the thermal conduction member contacts the heater so as not to overlap with an end region of the heat generation resistor in a longitudinal direction of the heat generation member.

10 Claims, 6 Drawing Sheets

FIXING APPARATUS

BACKGROUND OF THE INVENTION

1. Field of the Invention

This disclosure relates to a fixing apparatus provided in an image forming apparatus on the basis of an electrophotographic system such as printers and copying machine.

2. Description of the Related Art

Examples of a fixing apparatus in practical use provided in an image forming apparatus on an electrophotographic system include a configuration having a cylindrical film, a heater configured to come into contact with an inner surface of the film, a backup member defining a nip portion together with the heater via the film. The fixing apparatus of this type is capable of fixing a toner image on a recording material by heating the recording material having a toner image thereon while conveying the recording material by the nip portion.

The fixing apparatus is known to be subjected to a phenomenon that the temperature of a non-sheet passing region rises when a recording material having a smaller width than a maximum conveyable size of the apparatus (hereinafter, referred to as a "small-sized sheet" is conveyed by the nip portion, so-called "temperature rise in the non-sheet passing portion". Although an attempt is made to secure a long interval between a previous recording material and a following recording material in the case of a continuous printing in order to restrain the temperature rise in the non-sheet passing portion, there arises a problem that the productivity is lowered.

Accordingly, Japanese Patent Laid-Open No. 10-232576 discloses a fixing apparatus configured to restrain the temperature rise in the non-sheet passing portion without lowering the productivity by bringing an aluminum plate or the like into contact with a heater.

However, in the case where a thermal conduction member such as the aluminum plate is brought into contact with the heater over an entire area across a longitudinal direction like the configuration disclosed in Japanese Patent Laid-Open No. 10-232576, a temperature drop at end portions of the heater in the longitudinal direction may become prominent by heat movement and heat discharge accelerated at the end portions of the heater. Consequently, a fixation failure may occur at end portions in a widthwise direction when a maximum size recording material is passed.

SUMMARY OF THE INVENTION

According to a first aspect of the invention, there is provided a fixing apparatus configured to heat a recording material having a toner image formed thereon and fix the toner image on the recording material including: a cylindrical film; a heater configured to come into contact with the film, the heater including a substrate and a heat generation resistor formed on the substrate; a thermal conduction member configured to come into contact with a surface of the heater opposite to a surface that contacts the film, the thermal conduction member being a plate member having a thermal conductivity higher than that of the substrate; and a pressurizing roller configured to form a pressing portion with the heater via the film, wherein the thermal conduction member contacts the heater in a configuration so as not to overlap with end regions of the heat generation resistor in a longitudinal direction of the heat generation resistor.

According to a second aspect of the invention, there is provided fixing apparatus configured to heat a recording material having a toner image formed thereon and fix the toner image on the recording material including: a cylindrical film; a heater configured to come into contact with the film, the heater including a substrate and a heat generation resistor formed on the substrate; a thermal conduction member configured to come into contact with a surface of the heater opposite to a surface that contacts the film, the thermal conduction member having a thermal conductivity higher than that of the substrate; and a pressurizing roller configured to form a pressing portion with the heater via the film, wherein the thermal conduction member contacts the heater in a configuration so as not to overlap with end regions of the heat generation resistor in a longitudinal direction of the heat generation resistor, and wherein only the heat generation resistor having a resistance value of the end regions lower than a resistance value at a center portion in the longitudinal direction is provided.

Further features of the present invention will become apparent from the following description of exemplary embodiments with reference to the attached drawings.

DESCRIPTION OF THE EMBODIMENTS

First Exemplary Embodiment

Embodiments of this disclosure will be described below.

Image Forming Apparatus

Figure 1:
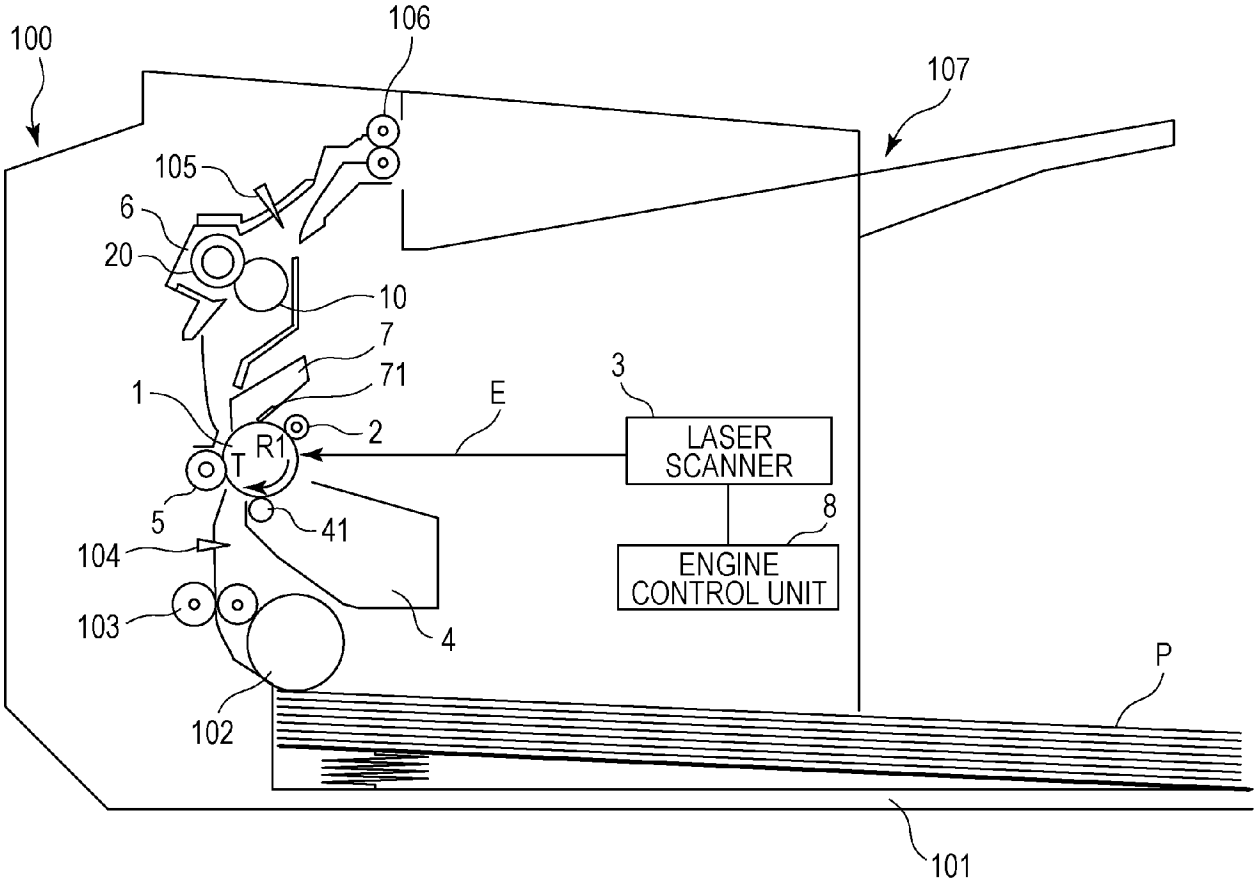
FIG. 1 is a configuration drawing of an image forming apparatus of a first exemplary embodiment.

FIG. 1 is a vertical cross-sectional view illustrating a schematic configuration of a laser printer as the image forming apparatus of this exemplary embodiment. First of all, referring to FIG. 1, the configuration of the laser printer (hereinafter, referred to as an image forming apparatus) will be described.

The image forming apparatus illustrated in FIG. 1 includes a photoconductive drum 1 as an image bearing member. The photoconductive drum 1 includes a photosensitive material such as OPC (organic optical semiconductor), amorphous selenium or amorphous silicon formed on a cylindrical drum base member formed of aluminum or nickel. The photoconductive drum 1 is driven to rotate at a predetermined process speed (circumferential velocity) in a direction indicated by an arrow R1.

A surface of the photoconductive drum 1 is charged at predetermined polarity and potential uniformly by a charge roller (charge member) 2.

The photoconductive drum 1 after having charged is provided with an electrostatic latent image by a laser beam E from a laser scanner (exposure member) 3. The laser scanner 3 is configured to perform scanning exposure controlled to be turned ON and OFF in accordance with image information, and is configured to remove electric charge on an exposed portion to form an electrostatic latent image on the surface of the photoconductive drum 1. The electrostatic latent image is developed and visualized by a developing apparatus (developing device) 4. A developing method including a combination of image exposure and inversion development performed by using a jumping developing method or a two-component developing method is used in many cases. Toner is adhered to the electrostatic latent image by a developing roller 41, so that the electrostatic latent image is developed as a toner image.

The toner image on the photoconductive drum 1 is transferred to a surface of a recording material P. The recording material P being stored in a paper feed tray 101 is fed one by one by a paper feed roller 102. The fed recording material P is supplied to a transfer nip portion T between the photoconductive drum 1 and a transfer roller 5 via a transfer roller 103. At this time, a leading edge of a transfer member P is sensed by a top sensor 104, and timing of arrival of the leading edge of the recording material P to the transfer nip portion T is sensed from a position of the top sensor 104, a position of the transfer nip portion T, and a conveyance speed of the transfer member P. The toner image on the photoconductive drum 1 is transferred to the transfer member P fed and conveyed at a predetermined timing as described above by applying a transfer bias to the transfer roller (transfer member) 5.

The recording material P having the toner image formed thereon is conveyed to a thermal fixing apparatus 6, is heated and pressurized while being conveyed by a nip portion between a film unit 10 and a backup member 20 of the thermal fixing apparatus 6, whereby the toner image is fixed to the recording material P. Subsequently, the recording material P to which the toner image is fixed is discharged to a paper discharge tray 107 by a paper discharge roller 106.

In contrast, after the toner image has transferred from the photoconductive drum 1 therefrom, toner remaining on the surface by not having been transferred to the recording material P (untransferred toner) is removed by a cleaning blade 71 of a cleaning apparatus 7, and is supplied to image formation for the next time.

By repeating the above-described actions, consecutive image formation may be performed.

The image forming apparatus of this exemplary embodiment is an example of an apparatus having specifications of 600 dpi, 30 sheets/minute (LTR vertical feed: a process speed of approx. 167 mm/s), and a processable number of sheets in life time of 1000000 sheets.

Thermal Fixing Apparatus

Figure 2A:
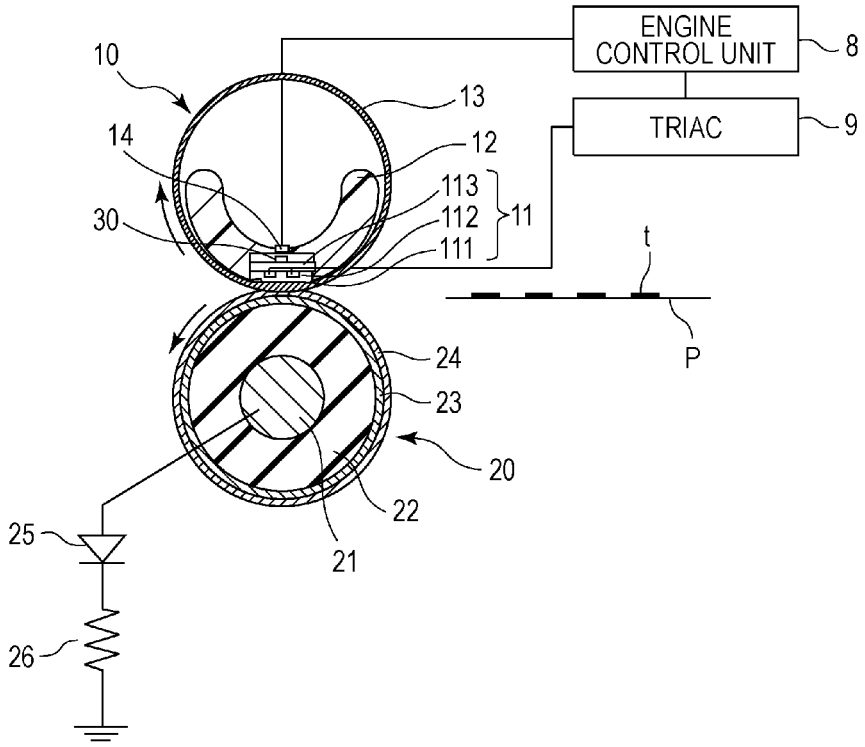
FIG. 2A is a lateral cross section of a thermal fixing apparatus of the first exemplary embodiment.
Figure 2B:
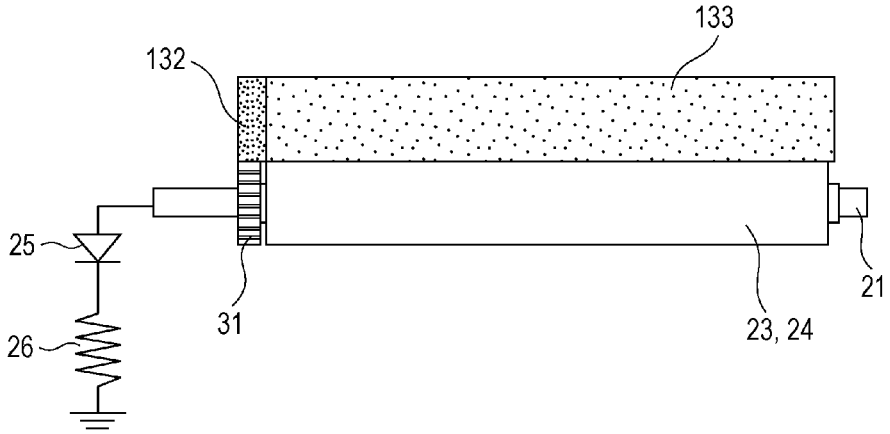
FIG. 2B is a drawing of the thermal fixing apparatus of the first exemplary embodiment viewed in the direction of conveyance.
Figure 3:
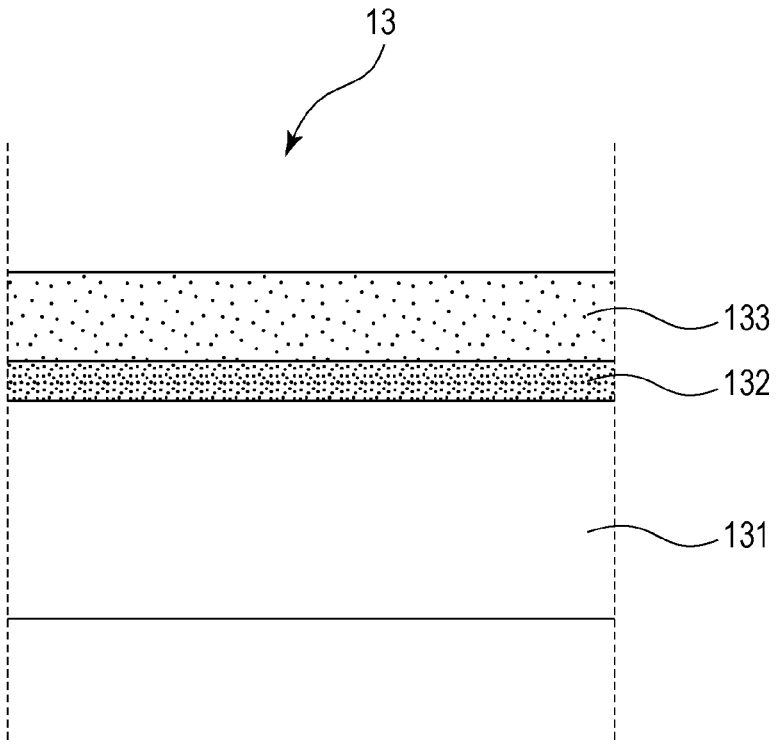
FIG. 3 is a drawing illustrating a configuration of a film of the first exemplary embodiment.

FIGS. 2A and 2B illustrate a configuration of the thermal fixing apparatus 6 of this exemplary embodiment. Reference numeral 13 denotes a cylindrical film. As illustrated in FIG. 3, the film 13 includes a base layer 131 formed of a metal such as stainless steel or a resin such as polyimide, and a releasing layer 133 formed of a fluorine contained resin such as PFA formed on the outside of the base layer 131. The releasing layer 133 is adhered to the base layer 131 via a primer layer 132. The thickness of the film 13 is preferably 100 μm or smaller in terms of quick starting properties, and is preferably 20 μm or more in terms of durability. Therefore, a thickness in a range from 20 μm to 100 μm inclusive is optimal.

The film 13 is grounded via a diode 25, which is a self-bias element as illustrated in FIG. 2 in order to prevent image failures such as offset. As a grounding method, the primer layer 132 having a low resistance is exposed to a surface of a film end portion, a conductive member 31 provided at an end portion of a pressurizing roller 20 is brought into contact with the exposed portion, and the conductive member 31 is grounded via the diode 25 and a safety resistance 26. The offset is effectively prevented by applying a bias having the same polarity as toner t by a high-voltage power source instead of the diode 25.

Reference numeral 11 is a heater coming into contact with an inner surface of the film 13. The heater 11 includes a substrate 111 formed of alumina or aluminum nitride, a heat generation resistor 112 formed of silver palladium formed on the substrate 111, and a protection layer 113 formed of glass configured to cover the heat generation resistor 112.

The film 13 is heated by bringing a surface of the heater 11 having the heat generation resistor 112 formed thereon or a back surface thereof into contact with the film 13. The surface of the heater 11 on the side opposite to the surface that comes into contact with the film 13 is provided with a thermistor 14 as a temperature sensing member via a thermal conduction member 30. A control unit 8 controls electric power to be supplied to the heater 11 by using a triac 9 to bring the temperature of the heater sensed by the thermistor 14 to a target temperature. Control of the heater 11 of this exemplary embodiment uses one triac 9, and hence is one-drive control. A resistance value of the heater 11 of this exemplary embodiment is 20Ω (720 W in input of 120V).

Reference sign 12 is a heater holder as a supporting member configured to support the heater 11, and is formed of liquid-crystal polymer, phenol resin, PPS, PEEK or the like. The film 13 is fitted loosely on the heater holder and is configured to be rotatable in a direction indicated by an arrow. Since the film 13 rotates in sliding contact with the heater 11 and the heater holder 12 in the interior thereof, it is required to restrain a friction resistance of the heater 11 and the heater holder 12 with respect to the film 13 to be low. Therefore, a small amount of lubricant such as heat-resistant grease or the like is applied on the surfaces of the heater 11 and the heater holder 12. Accordingly, the film 13 is allowed to rotate smoothly. In this exemplary embodiment, the film 13, the heater 11, and the heater holder 12 are unitized as the film unit 10.

The pressurizing roller 20 as the backup member forms the nip portion (pressing portion) with the heater 11 via the film 13. The toner image is fixed to the recording material by heating the recording material having the toner image formed thereon while conveying the recording material by the nip portion. The pressurizing roller 20 includes a core metal 21, a resilient layer 22 formed on the outside of the core metal 21, and a release layer 24 formed on the outside of the resilient layer 22. The core metal 21 is formed of aluminum or metal, the resilient layer 22 is formed of silicone rubber or fluorine-contained rubber, the release layer 24 is formed by covering or coating a tube in which a conductive agent such as carbon dispersed in PFA, PTFE, EFP or the like. A primer layer (adhesive layer) 23 is formed on the resilient layer 22 to adhere the release layer 24.

In the exemplary embodiment, an outer diameter of the pressurizing roller 20 is 20 mm, and a hardness of the roller is 48° (Asker-C 600 g waited).

The film unit 10 is pressed by a pressing member, which is not illustrated, against the pressurizing roller 20 at both end portions in the longitudinal direction. Accordingly, a pressure required for heating and fixing is obtained at the nip portion.

By driving the pressurizing roller 20 to rotate in the direction indicated by an arrow by a drive force, not illustrated, the film 13 may be driven to rotate in a direction indicated by an arrow in the drawing.

Figure 4A:
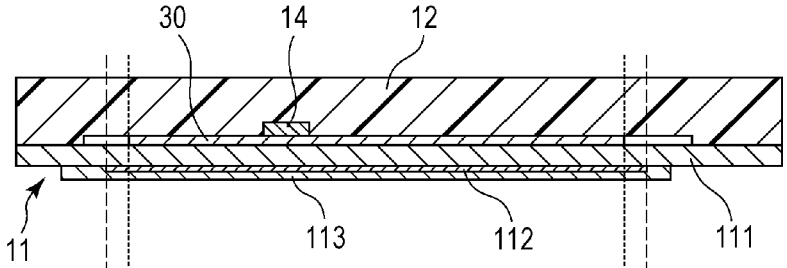
FIG. 4A is a cross sectional view of a heater, a thermal conduction member, and a supporting member of the first exemplary embodiment.

Subsequently, in this exemplary embodiment, a metallic plate 30 as a thermal conduction member (plate member) is brought into contact with the back surface of the heater 11. This is so that a thermal conductivity in the longitudinal direction of the film unit 10 is improved, and hence a temperature rise in the non-sheet passing portion is restrained in the case of continuous printing on a recording material of a small size. Referring now to FIG. 4, a positional relationship between the metallic plate 30 and the heat generation resistor of this exemplary embodiment will be described. FIG. 4A is a cross sectional drawing of the heater 11, the heater holder 12, and the metallic plate 30 viewed from the direction of conveyance of the recording material, and FIG. 4B is a drawing of the heater 11 and the metallic plate 30 viewed from the heater holder 12 side.

Figure 4B:
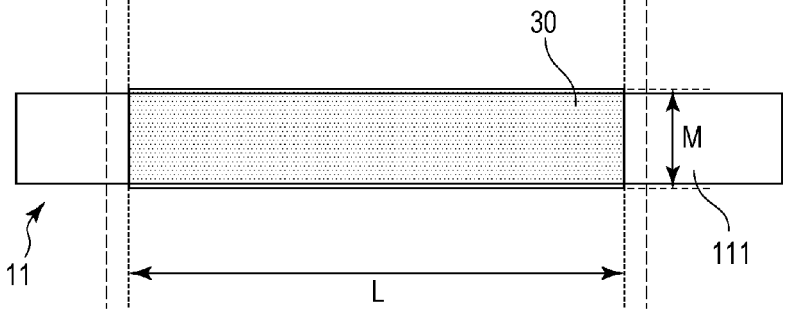
FIG. 4B is a drawing of the heater and the thermal conduction member of the first exemplary embodiment viewed from the supporting member side.

The substrate 111 of the heater 11 of this exemplary embodiment has a parallelepiped shape having a length in the longitudinal direction of 270 mm, a length in the short side direction of 5.8 mm, and a thickness of 1.0 mm as illustrated in FIG. 4B. In contrast, a length of the heat generation resistor 112 in the longitudinal direction (the generatrix direction of the film 13) is 218 mm. A length L of the metallic plate 30 in the longitudinal direction (the generatrix direction of the film) is 214 mm, and a width M in the direction of conveyance is 5.9 mm. A resistance value per unit length of the heat generation resistor 112 is constant in the longitudinal direction.

The length of the metallic plate 30 in the longitudinal direction is shorter than the length of the heat generation resistor 112 in the longitudinal direction. In other words, the metallic plate 30 is in contact with the heater 11 except for end regions of the heat generation resistor. It is because the temperature of the end portions of the heater 11 in the longitudinal direction is discharged and the temperature of the end portions tends to be lowered if the metallic plate 30 comes into contact with the entire area of the heat generation resistor 112 even though the length of the heat generation resistor 112 is set to be longer than the width of the recording material of a maximum size. In addition, by configuring the end portions of the metallic plate 30 in the longitudinal direction so as to come into contact with the non-sheet passing region of a standard sized recording material having a size next to the maximum size usable in the apparatus (A4 size in this exemplary embodiment), an effect of restraining the temperature rise in the non-sheet passing portion is improved.

Although the aluminum plate is used as the metallic plate 30 in this exemplary embodiment, the invention is not limited thereto, and copper and silver may be used as long as the material has higher thermal conductivity than the substrate 111. The material is not limited to metals, and graphite sheet is also applicable.

Subsequently, a method of holding the metallic plate 30 will be described. A configuration in which the metallic plate 30 is adhered to the heater 11 with an adhesive agent or the like is not employed in this exemplary embodiment because adhesiveness between the metallic plate 30 at the time of thermal expansion, and the heater 11 is deteriorated due to warping of the heater 11 caused by thermal expansion, and hence the effect of restraining the temperature rise in the non-sheet passing portion is impaired. For the same reason, a configuration in which metallic paste is screen printed on the substrate 111 is not employed in this exemplary embodiment. The thermal fixing apparatus of this exemplary embodiment employs a configuration in which the metallic plate 30 is held by being clamped between the heater holder 12 and the heater 11 as illustrated in FIG. 4A. This configuration has an advantage that the effect of restraining the temperature rise in the non-sheet passing portion is stabilized without deteriorating the adhesiveness between the heater 11 and the metallic plate 30 even when the metallic plate 30 and the substrate 111 have different coefficients of linear expansion. As a characteristic of this exemplary embodiment, the length of the heat generation resistor 112 is longer than the width of the recording material of the maximum size usable in the apparatus. In this exemplary embodiment, the recording material having the maximum size usable in the apparatus has an width of 216 mm for an LTR size recording material (vertical feeding), while the heat generation resistor 112 has a length of 218 mm. It is because fixability of the end portions when printed on the recording material having the maximum size is deteriorated when the temperature at the end portions of the heat generation resistor 112 of the heater 11 are lowered by heat discharge or the like when the metallic plate 30 is brought into contact with the entire area of the heat generation resistor 112 of the heater 11 in the longitudinal direction.

Experimental Example

Here, a result of conducting an experiment for confirming the effects of this exemplary embodiment will be described. In Table 1, Comparative Example 1 is a configuration in which the aluminum plate is not provided, Comparative Example 2 is a configuration in which the lengths of the heat generation resistor 112 and the aluminum plate 30 are the same, Comparative Example 3 is a configuration in which the aluminum plate 30 has a length longer than that of the heat generation resistor 112.

Fixability at an end portion (i.e. the ability of the end portion of the film to fix the toner to the recording material P) was evaluated by a fixability of the toner on the first sheet of recording material (sheets) after a cold start. The fixability was evaluated to be NG (no good) if a missing part were found in an image when an end portion of the fixed image was rubbed, and G (good) if no missing part were found. The sheet used in the experiment was Xx4200 (75 g/m2, LTR), and the image pattern was 2d/3s lateral lines. The temperature rise in the non-sheet passing portion is indicated by the temperature of the surface of the pressurizing roller 20 in the non-sheet passing portion when 150 pieces of the NPI (128 g/m$^2$, A4) were passed continuously.

TABLE 1

| | Length of Heat Generation Resistor | Length of Aluminum Plate | End-Portion Fixability | Temperature Rise in the Non-Sheet Passing Portion |
|---|---|---|---|---|
| Comparative Example 1 | 218 mm | NIL | G | NG (240° C.) |
| Comparative Example 2 | 218 mm | 218 mm or longer | NG | G (200° C.) |
| Comparative Example 3 | 222 mm | 240 mm | G | NG (240° C.) |
| First Exemplary Embodiment | 218 mm | 214 mm | G | G (210° C.) |

G . . . Good
NG . . . No Good

The following is apparent from Table 1. First of all, in the case of the configuration of Comparative Example 1, the fixability at the end portion had no problem. However, the temperature rise in the non-sheet passing portion exceeded 230° C., which was a limit temperature of the pressurizing roller 20. Subsequently, in the configuration of Comparative Example 2, the temperature rise in the non-sheet passing portion was restrained to remain under 230° C. However, the fixability at the end portion was deteriorated. It was because the temperature drop occurred at the end portions due to release of heat at the end portions as a result of provision of the aluminum plate 30. Subsequently, in the configuration of Comparative Example 3 in which the length of the heat generation resistor 112 was increased until the fixability at the end portion was not impaired even though the aluminum plate 30 was longer than the heat generation resistor 112, the temperature rise in the non-sheet passing portion was significantly deteriorated. It was because the length of the heat generation member 112 protruding from a sheet-passing region when the A4 size sheet passed therethrough was increased as a result that the longitudinal length of the heat generation member was increased for the purpose of securing the fixability at the end portion of the LTR (letter)-sized sheet, and hence the temperature rise in the non-sheet passing portion is significantly deteriorated.

Finally, in the configuration of this exemplary embodiment in which the length of the aluminum plate 30 was shorter than the longitudinal length of the heat generation resistor 112, the fixability at the end portion and the temperature rise in the non-sheet passing portion were both kept within a tolerable level. It was because the heat at the end portions could hardly be released as a result of the length of the aluminum plate 30 being shorter than the heat generation resistor 112. The effect of restraining the temperature rise in the non-sheet passing portion was obtained sufficiently in this exemplary embodiment.

Figure 5:
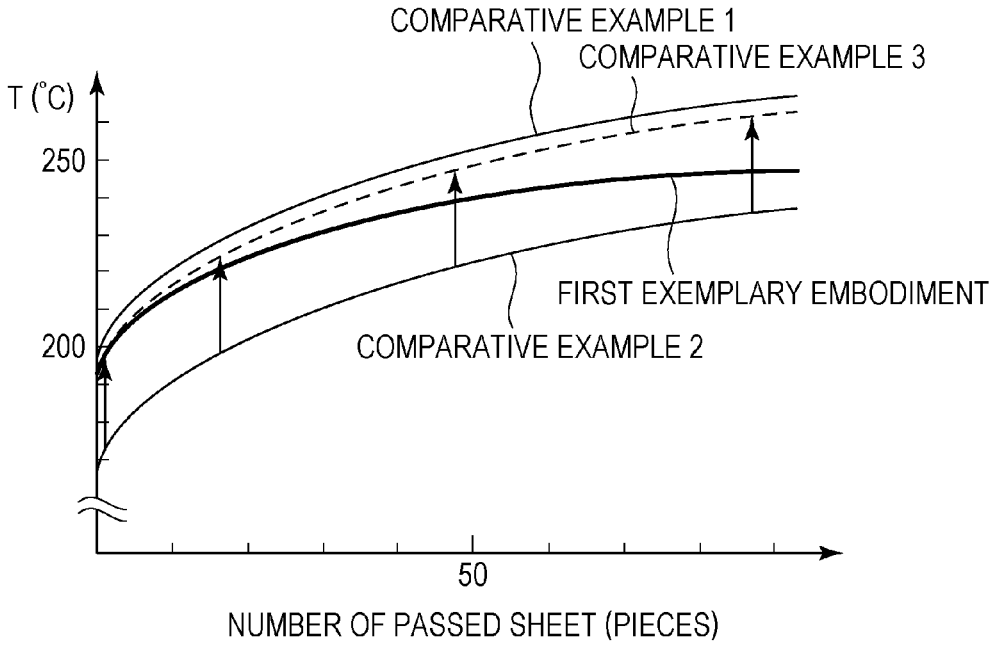
FIG. 5 is a drawing illustrating a temperature relationship between the number of printing sheets and an end portion of the heater of the first exemplary embodiment.

Subsequently, relationships between the number of passed sheets and the temperature of the end portions of the heater 11 in the longitudinal direction of Comparative Examples 1 to 3 and this exemplary embodiment will be described with reference to FIG. 5.

First of all, with the configuration of Comparative Example 2, the temperature rise in the non-sheet passing portion is improved in comparison with Comparative Example 1 in which the aluminum plate 30 is not provided. However, the fixability at the end portion in an initial stage of printing was deteriorated. In contrast, with the configuration of Comparative Example 3, although the fixability in the initial stage has no problem, the temperature rise in the non-sheet passing portion is deteriorated. With the configuration of this exemplary embodiment, both of the fixability at the end portion in the initial stage and the temperature rise in the non-sheet passing portion are within the tolerable range, and both are supported at the same time.

From the description given above, according to this exemplary embodiment, both of stable restraint of the temperature rise in the non-sheet passing portion by increasing adhesiveness between the heater and the thermal conduction member, and restraint of temperature drop at the end portions are supported.

Second Exemplary Embodiment

A different point in configuration between a second exemplary embodiment and the first exemplary embodiment is only a heat generation resistor 114. Therefore, description of other configuration will be omitted.

Figure 6:
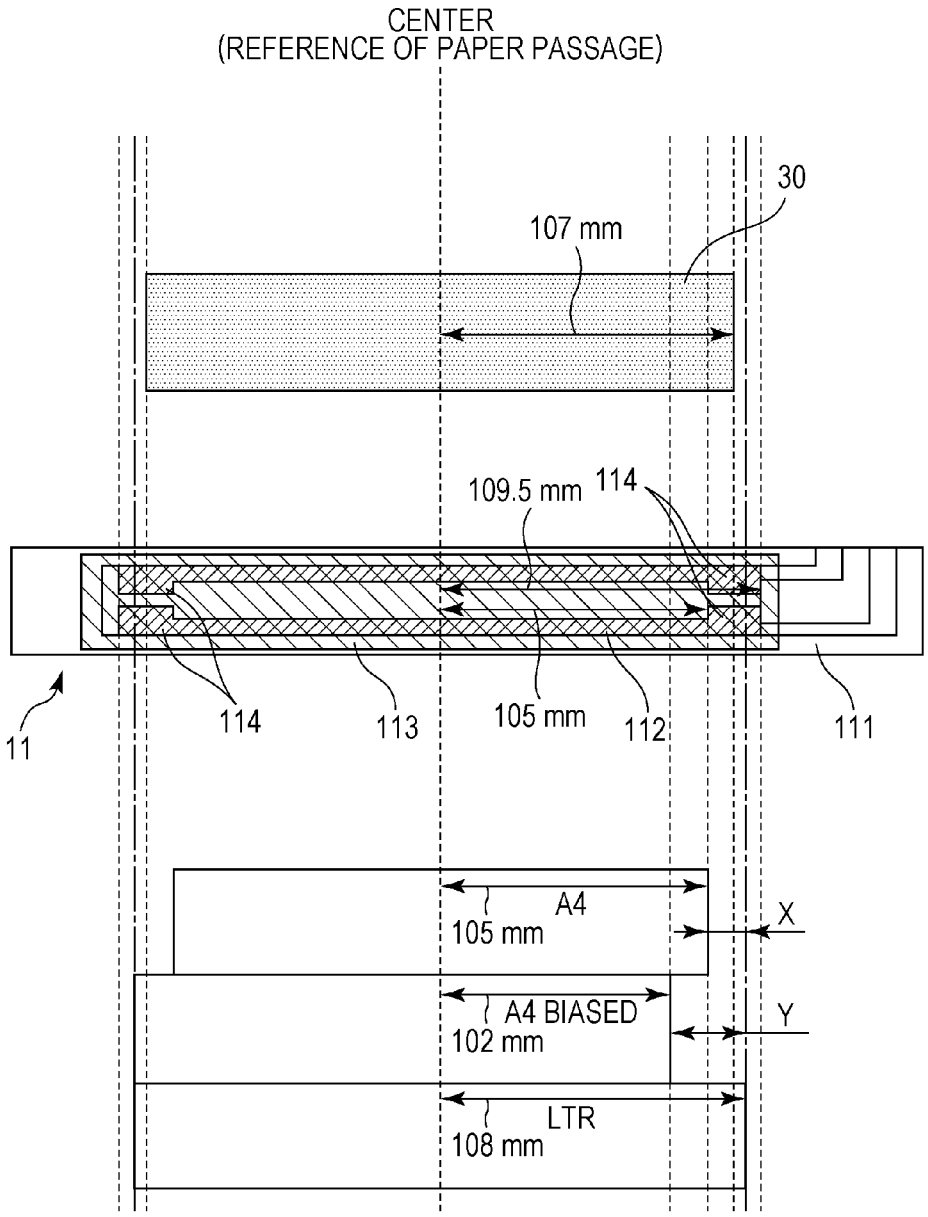
FIG. 6 is a drawing illustrating a positional relationship between a heater (heat generation resistor) of a second exemplary embodiment and the thermal conduction member.

The thermal conduction member 30 of this exemplary embodiment is shorter than the heat generation resistor 114 in the same manner as the first exemplary embodiment as illustrated in FIG. 6, and the thermal conduction member 30 is in contact with the heater 11 except for the end regions of the heat generation resistor 114 in the generatrix direction of the film 13. A different point between this exemplary embodiment and the first exemplary embodiment is that the resistance value per unit length of the end regions of the heat generation resistor 114 where the thermal conduction member 30 is not in contact is lower than that of a center portion. In other words, the heat generation amount of the end regions of the heat generation resistor 114 is set to be smaller than the center portion. The heat generation resistor of this exemplary embodiment is provided only with the heat generation resistor 114, and heat generation distribution of the heater 11 in the generatrix direction of the film 13 is always smaller in the end portions than the center portion.

The specific configuration of this exemplary embodiment is that the width of the end regions of the heat generation resistor 114 in the short side direction is set to be larger than the center portion of the heat generation resistor 114. In this exemplary embodiment, the end portions of the thermal conduction member 30 in the longitudinal direction is in contact with the non-passing region (the region X in FIG. 6) of the recording material (A4 size in this exemplary embodiment) having a size next to the maximum size usable in the apparatus (LTR size in this exemplary embodiment).

If only restraint of the temperature rise in the non-sheet passing portion when the paper is passed through in a biased manner is required, the end portions of the thermal conduction member 30 needs only be in contact with the non-sheet passing region (the region Y in FIG. 6) when one end of the recording material in the widthwise direction having a second largest width is aligned with one end of the recording material in the widthwise direction having the maximum size.

Subsequently, the effects of this exemplary embodiment will be described. The productivity of the printer of this exemplary embodiment is 40 sheets/minute (LTR vertical feed: a process speed of approximately 222 mm/s), which is higher than the first exemplary embodiment. Therefore, the resistance value of the heater 11 is set to 13.8Ω, and an input power is larger than the first exemplary embodiment (1043 W at 120V input).

If the maximum power which can be input to the heater 11 is increased, the maximum electric power is continuously supplied to the heater 11 when the heater 11 is out of control, and hence a phenomenon that the heater 11 is broken, so called "runaway heater breakage" tends to occur. The state in which the heater 11 is out of control in this case corresponds to a state in which a triac or a relay used in a power circuit is broken, and hence a primary current is continuously flowed to the heater 112 without being controlled. As a result of runaway of the control of the heater 11, the heater 112 is excessively increased in temperature, and an excessive thermal stress or mechanical stress is applied to the substrate 111. Consequently, the substrate 111 may be broken and the usage of the heater 11 may be disabled. In order to avoid the "runaway heater breakage" there is a method of shutting down the primary current by operating a safety element or the like when the primary current flows in before the heater 11 is excessively increased in temperature and the substrate 111 is cracked. In such a case, the substrate 111 is required to be capable of resisting against the thermal stress or the mechanical stress for a longer time than a length of time until the safety element is activated.

In the case where the heat generation resistor 114 has the end regions protruding from the thermal conduction member 30, and the input power to the heater 11 is large as in this exemplary embodiment, the end regions of the heat generation resistor 114 tends to rise in temperature, and the portion in contact with the thermal conduction member 30 hardly rises in temperature. Therefore, the temperature difference of the substrate 111 is increased, and the time until the heater breakage occurs due to the thermal stress becomes shorter. Therefore, in this exemplary embodiment, the heat generation amount in the end regions of the heat generation resistor 114 protruding from the thermal conduction member 30 is reduced to be lower than the center portion of the heat generation resistor 114 in the longitudinal direction as illustrated in FIG. 6. Accordingly, the temperature difference between the end regions of the heat generation resistor 114 protruding from the thermal conduction member 30 and the portion with which the thermal conduction member 30 is in contact becomes small, and the period until occurrence of the heater breakage is elongated and hence the heater breakage may be retarded until the timing when the safety element is activated.

Conceivable variations in configuration which reduces the heat generation amount in the end regions of the heat generation resistor 114 include thickening the end regions of the heat generation resistor 114 to be thicker than the center portion, and lowering the resistance value of the material of the heat generation resistor to be lower than that of the center portion in addition to the configuration of this exemplary embodiment.

Table 2 illustrates a relationship among the heat generation amount of the end regions of the heat generation resistor 114 protruded from the thermal conduction member 30, the fixability at the end portion, and the runaway heater breakage. In addition, a result obtained by deriving a temperature distribution of the heater 11 by simulation using an finite element method, and deriving a maximum thermal stress in the end regions of the heat generation resistor 112 obtained therefrom are both shown for reference. The heat generating amount of the end regions of the heat generation member shown in the table are relative values when the heat generating amount of the heat generation member 112 of a temperature sensing unit is assumed to be 100%. The evaluation method, the used recording material, and the image pattern are the same as the first exemplary embodiment as regards the fixability at the end portion, and hence description will be omitted.

TABLE 2

| Heat Generation Amount of heat generation resistor (End Potions) | End Portion Fixability | Heater Breakage | Heater maximum stress (reference value) | End portions temperature rise |
|---|---|---|---|---|
| 100% Comparative Example) | G | NG (cracking occurred) | 120 MPa | G (229° C.) |
| 90% | G | G (no cracking occurred) | 80 Mpa | G (221° C.) |
| 80% | G | G (no cracking occurred) | 50 Mpa | G (213° C.) |
| 70% | M | G (no cracking occurred) | 30 MPa | G (205° C.) |

G . . . Good
M . . . Allowable level
NG . . . defect

It is understood from Table 2 that when the heat generation amount of the end regions of the heat generation resistor 114 protruded from the thermal conduction member 30 is 100%, the heater breakage occurs at the time of the heater runaway, while if the heat generation amount is 90% or lower, the heater breakage does not occur. In contrast, it is understood that although the fixability at the end portion is lowered as the heat generation amount of the end regions of the heat generation member is lowered, if the heat generation amount is on the order of 80% or higher a desirable flexibility is obtained, or even with 70%, the fixability within an allowable range is obtained. The heater stress (reference value) derived by the simulation has a tendency that the thermal stress of the heater is lowered as the heat generation amount at the end regions of the heat generation member, and a situation advantageous to the heater breakage is assumed. Although not shown in Table 2, it is needless to say that the problem of the temperature rise in the non-sheet passing portion becomes better by lowering of the heat generation amount of the end regions of the heat generation member.

From the description given above, this exemplary embodiment has advantages that the heater breakage at the time when the control of the heater is runaway is prevented in addition to the fact that the restraint of the temperature rise in the non-sheet passing portion and the restraint of the temperature drop at the end portions are both achieved simultaneously.

In the invention described in accordance with the first and second exemplary embodiments, the heater is in contact with the inner surface of the film and the heater forms the nip portion for conveying the recording material in cooperation with the pressurizing roller via the film. However, the invention is not limited thereto. A configuration in which the heater comes into contact with an outer surface of the film and the backup member forms the pressing portion with the heater via the film is also applicable. In this case, the pressurizing roller comes into contact with the film at portion other than the pressing portion, and forms the nip portion with the film for conveying the recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-240148, filed Nov. 20, 2013 which is hereby incorporated by reference herein in its entirety.

What is claimed is:

1. A fixing apparatus configured to heat a recording material having a toner image formed thereon and fix the toner image on the recording material comprising:

a cylindrical film;

a heater configured to come into contact with the film, the heater including a substrate and a heat generation resistor formed on the substrate;

a thermal conduction member configured to come into contact with a surface of the heater opposite to a surface that contacts the film, the thermal conduction member being a plate member having a thermal conductivity higher than that of the substrate;

and a pressurizing roller configured to form a pressing portion with the heater via the film, wherein the thermal conduction member contacts the heater in a configuration so as not to overlap with end regions of the heat generation resistor in a longitudinal direction of the heat generation resistor, and wherein a resistance value of the end region of the heat generation resistor is lower than a resistance value of a center portion of the heat generation resistor in the longitudinal direction.

2. The fixing apparatus according to claim 1, wherein a length of the heat generation resistor is longer than a maximum width of a recording material usable in the apparatus in the longitudinal direction.

3. The fixing apparatus according to claim 1, wherein the thermal conduction member overlaps with a non-sheet passing region of the recording material having the maximum width except for a recording material having the maximum width usable in the apparatus in the longitudinal direction.

4. The fixing apparatus according to claim 1, further comprising a supporting member configured to support a surface of the heater opposite to a surface that contacts an inner surface of the film, wherein the thermal conduction member is interposed between the heater and the supporting member.

5. The fixing apparatus according to claim 1, wherein the heater is in contact with the inner surface of the film, and wherein the pressing portion is a nip portion for conveying the recording material.

6. A fixing apparatus configured to heat a recording material having a toner image formed thereon and fix the toner image on the recording material comprising:

a cylindrical film;

a heater configured to come into contact with the film, the heater including a substrate and a heat generation resistor formed on the substrate;

a thermal conduction member configured to come into contact with a surface of the heater opposite to a surface that contacts the film, the thermal conduction member having a thermal conductivity higher than that of the substrate;

and a pressurizing roller configured to form a pressing portion with the heater via the film, wherein the thermal conduction member contacts the heater in a configuration so as not to overlap with end regions of the heat generation resistor in a longitudinal direction of the heat generation resistor, and wherein only the heat generation resistor having a resistance value of the end regions lower than a resistance value at a center portion in the longitudinal direction is provided.

7. The fixing apparatus according to claim 6, wherein a length of the heat generation resistor is longer than a maximum width of a recording material usable in the apparatus in the longitudinal direction.

8. The fixing apparatus according to claim 6, wherein the thermal conduction member overlaps with a non-sheet passing region of the recording material having the maximum width except for a recording material having the maximum width usable in the apparatus in the longitudinal direction.

9. The fixing apparatus according to claim 6, further comprising a supporting member configured to support a surface of the heater opposite to a surface that contacts an inner surface of the film, wherein the thermal conduction member is interposed between the heater and the supporting member.

10. The fixing apparatus according to claim 6, wherein the heater is in contact with the inner surface of the film, and wherein the pressing portion is a nip for conveying the recording material.

* * * * *